United States Patent [19]

Fuchs

[11] 4,401,171

[45] Aug. 30, 1983

[54] UNDERREAMER WITH DEBRIS FLUSHING FLOW PATH

[75] Inventor: Benjamin H. Fuchs, Long Beach, Calif.

[73] Assignee: Dresser Industries, Inc., Dallas, Tex.

[21] Appl. No.: 329,361

[22] Filed: Dec. 10, 1981

[51] Int. Cl.[3] ..... E21B 10/18; E21B 10/34

[52] U.S. Cl. ..... 175/267; 175/237

[58] Field of Search ..... 175/267, 268, 269, 237, 175/313; 166/317, 318

[56] References Cited

U.S. PATENT DOCUMENTS

| | | | |
|---|---|---|---|
| 1,839,767 | 1/1932 | Lopez | 175/267 |
| 1,899,727 | 2/1933 | Sandstone | 175/263 |
| 2,238,377 | 4/1941 | Strang | 175/267 X |
| 3,483,934 | 12/1969 | Fuchs | 175/267 |
| 3,750,771 | 8/1973 | Cugini | 175/269 |

*Primary Examiner*—Stephen J. Novosad
*Assistant Examiner*—Joseph Falk
*Attorney, Agent, or Firm*—Fred A. Winans

[57] ABSTRACT

An underreamer having a plurality of drilling arms hingedly attached to a tubular body for movement between a retracted position and an extended position for drilling. The underreamer includes a central wash pipe for delivering drilling mud to remove cuttings and debris from the hole during drilling and an alternate flow path, generally through the body for delivering drilling fluid to the vicinity between the arm and the body to flush debris therefrom which would prevent the arms from retracting to their normal position for withdrawal from the borehole.

8 Claims, 5 Drawing Figures

UNDERREAMER WITH DEBRIS FLUSHING FLOW PATH

BACKGROUND OF THE INVENTION

1. Field of the Invention

This invention relates to an earth boring tool commonly known as an underreamer and, more particularly, to such a tool having an alternate fluid flow path therethrough for flushing debris from beneath the extended arms of the tool to permit retraction of the arms to within the body of the tool.

2. Brief Description of the Prior Art

Underreamers are well known tools used in the well drilling art to enlarge portions of a borehole in oil and gas wells for various purposes. The underreamer generally comprises a tubular body having a pilot cutter or underreaming lugs at one end and threaded means at the opposite end for connection to a drill string. The tubular body includes a plurality of axially elongated cavities. An elongated cutter arm is housed within each cavity with the lower end of the arm supporting a rotating cone cutter and the opposite end hinged to the body through a hinge pin assembly for rotational movement of the arm from within the cavity to an extended position wherein the cutter is effective to contact the wall of the borehole and enlarge it.

The tool also includes an axially moveable central wash pipe in fluid flow communication with the drilling mud for circulating mud to the borehole to flush the cuttings therefrom. The washpipe normally includes a piston having a limited size opening therethrough, in sliding sealing engagement with the central axial bore of the tubular body, and a pipe portion extending therefrom with a jet nozzle at its lower end for jetting the drilling fluid therefrom. A cam member defining a plurality of cam lobes is attached to the pipe adjacent the lower end thereof with each lobe in alignmet with cam follower surfaces defined on the back faces of the hinged arms so that as the wash pipe moves axially downwardly under the influence of an increase in pressure of the drilling fluid on the face of the piston, the cam lobes contact the surfaces and force the arms from a retracted position generally flush with the surface of the tubular body, to the full extended position.

A spring member is disposed below the piston and a lower shoulder in the internal bore of the body and normally biases the piston to its axially upward position corresponding to the cam lobes permitting the arms to be in the retracted position. Thus, when the underreamer operation is completed, the mud pressure is reduced to normal to permit the spring to return the piston to this position. In such position the arms are permitted to return to the retracted position under their own weight.

However, it can be appreciated, that with the arms enlarging the borehole, the circulating drilling mud in the vicinity of the arms does not necessarily flow past the extended arms and cutters with sufficient velocity and controlled flow pattern to insure that the cuttings will be removed from between the extended arms and the body or from the arm cavities and hinge area. As a matter of fact, it is the general experience that, without some special fluid flow path for flushing this specific area, it is not uncommon for the cuttings to prevent the full retraction of the arms. Further, during withdrawal of the tool from the borehole, it is not always apparent to the drilling personnel that the arms are not retracted to the flush position and thus, the extended arms, upon withdrawal engage the borehole as it is being withdrawn through the portion that was not underreamed.

It is thus readily apparent that upon retracting the tool from the borehole, as the downwardly outwardly extending arms contact the narrow portion of the borehole or casing, the upward withdrawing force places considerable force on the arms to retract them to the flush position. However, if cuttings or debris such as compacted gumbo or rock fragments interfere with the closing, this force is transmitted to the hinge assembly and multiplied by the leverage of the arm about the obstruction. This in turn has resulted in the damage and total destruction of the hinge assembly, and can even cause loss of the arm downhole.

It is known to continuously divert a portion of the drilling fluid to and through the hinge assembly as shown in U.S. Pat. No. 1,899,727 or jetted, through directional jets from the wash pipe toward the underarm area. In that such jets or flow paths are not consistent with providing the maximum flow for flushig the borehole, although they provide some useful debris dislodging, they are not sufficiently dependable.

SUMMARY OF THE PRESENT INVENTION

The present invention provides an underreamer of the general description as above however with an alternate drilling mud flow path providing a primary flow path to beneath the extended arm area in the event the withdrawal force indicates the arms are lodged in an extended position.

Thus, the tool of the present invention provides an annular fluid diverter valve in the tool bore ahead of the cam actuating piston of the wash pipe. The diverter valve has a central axial opening therethrough for normal drilling fluid flow therethrough and generally sealingly engages the wall of the tool bore in axial sliding engagement. Under normal operating conditions the valve is stationarily retained by a shear pin extending from the bore into a circumferential groove in the valve. In such position the valve covers a plurality of inlet ports in the wall of the tool, leading to axially extending flow paths with the outlet ports in the bore immediately upstream of the arm hinge assembly area.

Whenever it is desirable to flush debris from the underside of the hinge and arm assembly and/or also flush the openings in the tool in which the arms rest in a retracted position, a restrictor (i.e. ball, etc.) or inertia bar (i.e. sinker bar) is placed into the drill string mud circulation system. Upon reaching the diverter valve, the shear pin (or a ball detent) is overcome by the increase of hydraulic pump pressure due to the restricted flow or the striking force of the sinker bar, forcing the diverter valve axially downwardly to expose the inlet ports. As these ports lead to the flow paths to exit again at the internal bore and in the wash pipe area immediately upstream of the arms, an annular downward jet of fluid is formed which flushes debris from this area.

Thus, a normal fluid flow is maintained during drilling operations allowing for flushing the borehole and a selectively actuated flow path is provided for fluid impingement and circulation to the critical portions of the tool when necessary for freeing the arm assembly for retraction within the tool body.

Further, this alternate drilling fluid flow path provides a drainage of the drilling mud from the drill string during tripping of the drill string in the event that the primary flow path becomes clogged such as at the nozzle or choke of the wash pipe.

DESCRIPTION OF THE PREFERRED EMBODIMENT

Figures 1, 2:
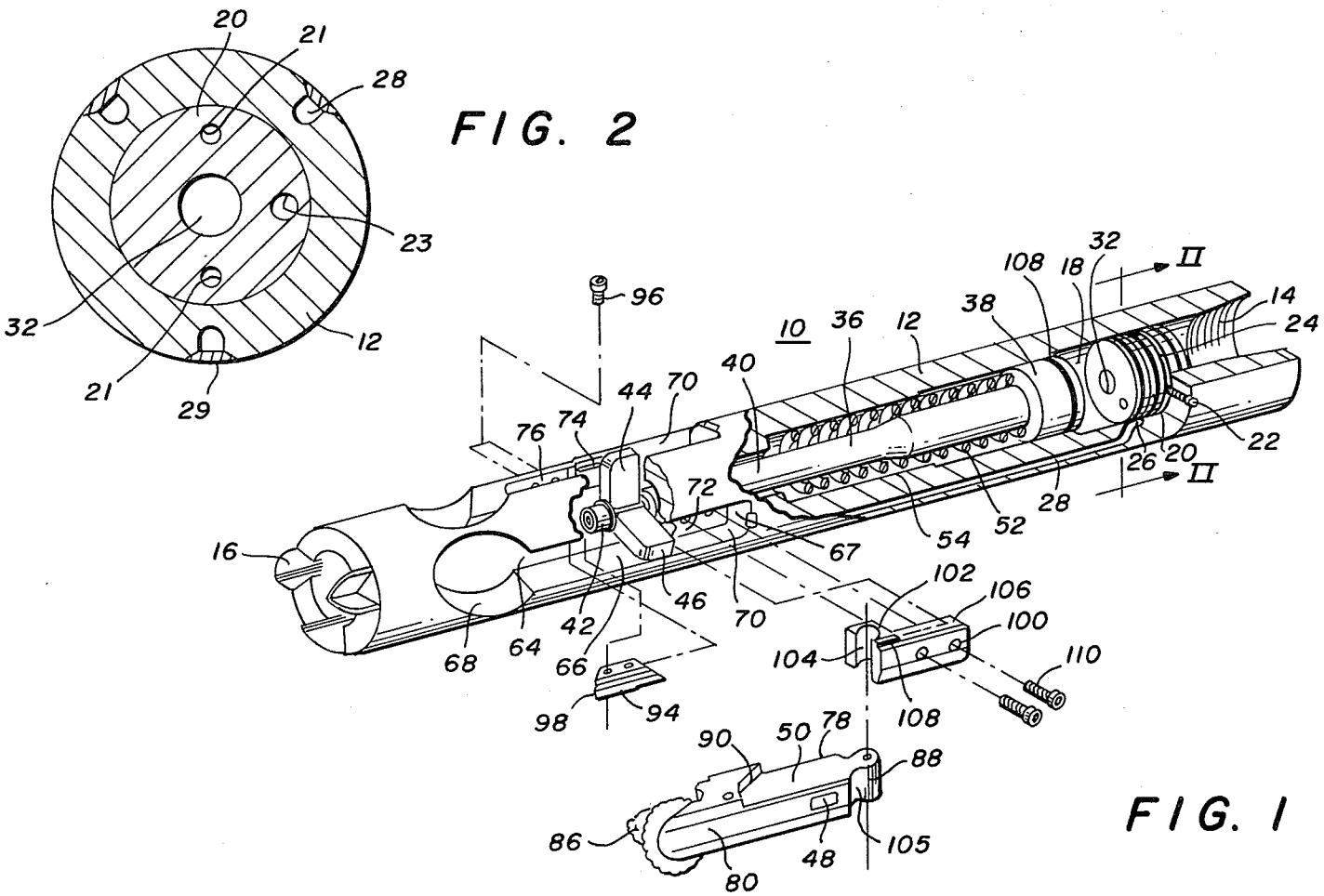
FIG. 1 is an exploded isometric view, with parts broken away, of an underreamer according to the present invention.
FIG. 2 is a cross-sectional view generally along line II—II of FIG. 1.

Referring initially to FIG. 1, an underreamer tool 10 is shown as comprising a tubular body 12 having an upper internally threaded box portion 14 and a lower end having pilot earth-boring cutter elements 16 such as underreaming lugs projecting therefrom.

The body 12 has an axial bore throughout its length, which bore is sectioned into separate axial portions including an upper cylinder portion 18 housing a diverter valve piston 20 which is, under normal conditions, axially stationarily retained therein by a shear pin 22 extending through the body wall into a circumferential groove 24 in the piston. The piston 20 sealingly engages the bore wall and normally blocks a plurality of inlet ports 26 (only one being shown) each leading to a flow channel 28 in the tool wall and extending therefrom to an outlet port 30 (see FIG. 3) in the bore just upstream of the hinged arms 50, described later herein.

Figure 3:
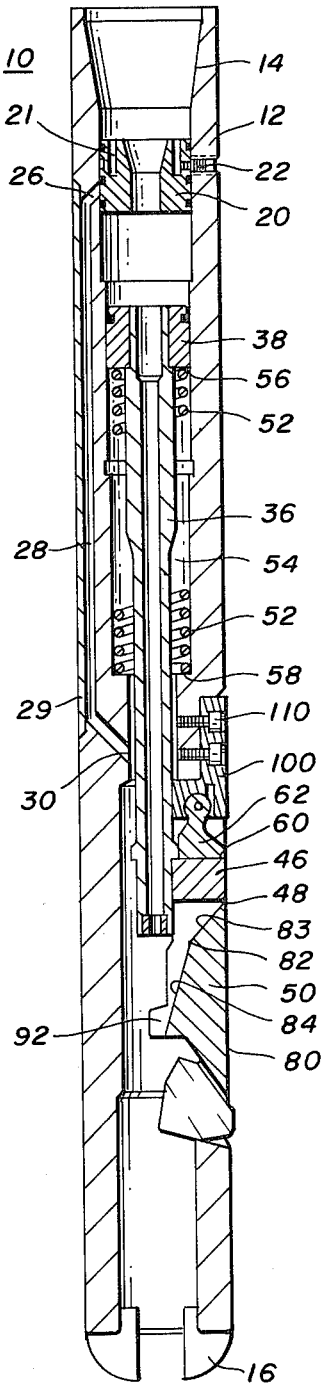
FIG. 3 is an axial cross-section view of the underreamer with the arms in retracted position.
Figure 4:
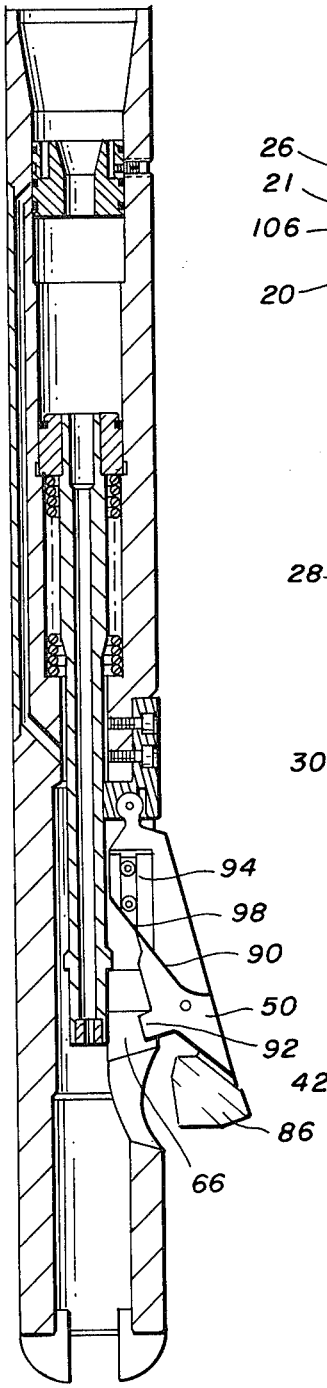
FIG. 4 is a view similar to FIG. 3 with the arms in extended position.
Figure 5:
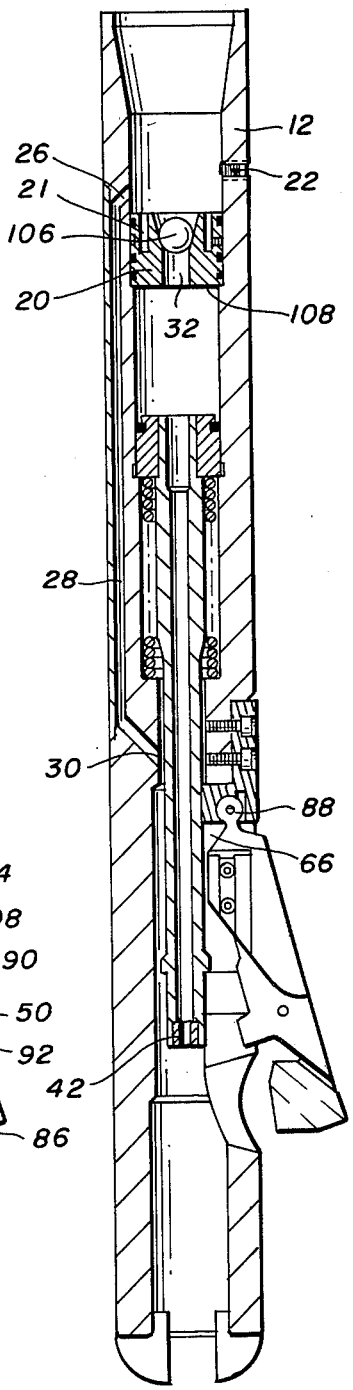
FIG. 5 is a view similar to FIG. 4 with the alternate flow path open for flushing debris from beneath the extended arms.

Referring now to FIGS. 1 and 2, it is seen each inlet port 26, leads to a separate channel 28, (three being shown) which are machined into the sidewall of the tool and covered by a plate member 29 welded thereover. Also, it is seen that the valving piston 20 defines a large central opening 32 axially therethrough for delivering drilling fluid pumped through the drill string into bore chamber 34 immediately above an axially moveable wash pipe 36 disposed in the bore, and a smaller offset opening 23 also permitting drilling fluid flow therethrough. Opening 32 has a tapered throat as shown in FIGS. 3-5. Threaded openings 21 extend partially therethrough for a purpose explained later.

Referring again to FIG. 1, the moveable wash pipe 36 includes a piston 38 at the upper end, and a pipe portion 40 terminating in a downwardly directed jet nozzle 42 adjacent the undersurface of arms 50. A cam member 44 is mounted on the lower end of wash pipe 36 and defines a plurality of cam lobes 46 projecting radially therefrom and as seen in FIG. 3 nesting in an appropriate cavity 48 in a hinged cutter arm 50 when the arm is in a retracted position.

Referring to FIGS. 1 and 3, a coil spring 52 is enclosed in an intermediate portion 54 of the bore and encircles the wash pipe, engaging the under-surface 56 of the piston 38 and a shoulder 58 in the bore to bias the wash pipe to an upper position in which the upper surface 60 of cam lobe 46 engages a complimentary upper surface 62 of the arm cavity 48.

The lower end of the tubular body 12 defines a plurality of axially elongated cavities or openings 64 (preferably three such openings are provided, but only two are shown in FIG. 1) equangularly disposed therein and extending completely through the wall. The openings are generally defined by parallel facing axially disposed sidewalls 66, terminating at their lower end in an enlarged circular opening 68 and at the opposite or upper end in a recess 70 having a planar bottom wall 72. At least one sidewall 66 has an axial keyway 74 slotted therein generally sub-adjacent the recess 70 and a notch 76 immediately below the keyway for receipt therein of a stop member 94 to be discussed later.

A cutter arm 50 is disposed in each elongated opening 64 and, as shown in FIG. 1, defines an axially elongated substantially rectangular member having opposite sidewalls 78, a front face 80 and a rear surface 82 (see FIG. 3) defining camming surfaces 83, 84. A rotary cone cutter 86 is mounted on a bearing pin (not shown) extending from the lower end thereof. The opposite or upper end of the arm 50 is configured to define a cylindrical arm boss 88 having an axis generally perpendicular to the axis of the tubular body 12 and connected to the main body of the arm through a reduced thickness neck 105. The boss 88 is inset from the surface 80 of the arm and extends completely across the width of the arm 50.

The opposite sides 78 of the cutter arm 50 define an outwardly projecting diagonally extending shoulder 90 and a rearwardly extending tab member 92 (see FIG. 3) respectively. Shoulder 90 abuts the arm stop plate 94 configured to nest within the notch 76 and removably retained therein by cap screws 96 extending through apertures in the body, and defining a stop surface 98 for facing contact with the shoulder 90 when the arm is in the full extended position illustrated in FIG. 4.

An arm hinge plate 100 is configured to be nested within recess 70 in general abutting engagement with the sidewalls 66 and topwall 67 thereof and defines an inwardly extending foot portion 102 having a cylindrical socket 104 extending therethrough, open on the bottom end to permit the neck portion 105 of the cutter arm to extend therethrough when the cylindrical boss is disposed within the socket. One sidewall 106 of the plate 100 defines a key 108 projecting therefrom for mating, sliding engagement in the keyway 74 in the sidewall 66 of the opening 64. A pair of cap screws 110 extend through appropriate apertures in the plate 100 into the threaded openings in the bottom surface 72 of the recess 70.

Thus, as shown by dotted lines in FIG. 1, assembly of the cutter arm 50 to the underreamer body first requires insertion of the cylindrical boss 88 of the arm 50 into the matching cylindrical socket 104 of plate 100. The plate is then placed in the opening 64 in alignment with and axially below the recess 70 and moved axially upwardly into abutting engagement with top wall 67 within the recess and to engage the key 108 in the keyway 74. The plate is axially retained therein by the screws 110. The arm is then disposed in the retracted position and the arm stops 94 are inserted into notch 76 and retained therein by the screws. As such, the cutter arm 50 is hinged by the mating cylindrical boss and socket 88, 104 arrangement for movement between an extended position as limited by engagement of the shoulder 90 with the arm stop shoulder 98 (see FIG. 4) and a retracted position wherein the surface of the arm is generally flush with the surface of the tubular body (See FIG. 3). In the extended position of the cutter arm 50, the tab member 92 projects rearwardly sufficient to engage a sidewall 66 of opening 64 to transmit the rotary movement of the body to the arm therethrough.

Referring to FIGS. 3 and 4, the arm 50 is shown in retracted (FIG. 3) and extended (FIG. 4) position. The transition from retracted to extended position during drilling operations is gradual in that the diameter of the borehole being enlarged is generally only slightly larger than the diameter of the tubular body member. Thus, under increased drilling mud pressure, the increased pressure on the piston 38 of the wash pipe 36 forces the wash pipe axially downwardly causing lobe 46 to contact cam surface 83 of the arm urging the arms outwardly. As borehole disintegration occurs, during rotation of the tool, both outwardly and downwardly, the borehole is enlarged by a tapered wall until the arms 50 reach their fully extended position, and thereafter the borehole is enlarged to this constant extended diameter.

When it is desired to remove the underreamer 12 from the borehole, for any reason, the drilling mud pressure is reduced or mud flow is discontinued altogether. This removes the excess pressure on the wash pipe piston 38 permitting the spring 52 to return the wash pipe to the uppermost position. This moves cam lobes 46 back into alignment with openings 48 in the arms, permitting the arms, under their own weight, to collapse into the retracted position of FIG. 3. Abutment of the upper surface 60 of cams 44 against the upper surface 62 of opening 48 assists in urging the arms to the retracted position.

However, if, because of drilling debris lodged in the hinge assembly or between the wash pipe and the arms or at other critical areas in the openings 64, the arms are prevented from full retraction, the contact between the arms as the tool is being withdrawn through the unenlarged area of the borehole, places a considerable force on the arms, and especially the hinge assembly. At this point, an experienced driller can tell from the increased upward force to withdraw the tool, that the arms have not fully retracted. Thus, with the tool of the present invention, and with reference to FIG. 5, the underarm area of the tool can be flushed of blocking debris in the following manner.

A restrictor ball 106 is inserted in the mud circulating system so as to flow down the drill string and into the underreamer 12. The ball 106 is sized so as to fit within the tapered throat of opening 32 to restrict the flow of drilling fluid causing the valve piston 20 to take the full pumped mud pressure (except for the limited flow through opening 21, which is insufficient to relieve this pressure but is sufficient to permit some limited flow to continue through the wash pipe). This pressure causes shear pin 22 to fail which permits downward axial movement of valve piston 20 to become seated on a shoulder 108, uncovering ports 26. The main drilling fluid mud flow is thus diverted through passages 28 to exit within the bore at outlet ports 30, into an annular space between the bore and the wash pipe and thereby providing an annular jet of drilling fluid in the immediate vicinity of the arm hinge 88 and opening 66 to flush this area of blocking debris. With the blocking debris removed, the arms can retract into the opening 64 and the tool withdrawn from the borehole without damage.

Once the tool is withdrawn and disconnected from the drill string, elongated screws can be manually inserted into the threaded openings 21 to axially withdraw the diverter piston 20 to realign it with another shear pin (after removal of the remaining stub of the previous pin) to reseat the diverter valve in its initial blocking position.

It is also apparent that should the jet nozzle 42 become plugged such that the drill string above the tool contains a column of drilling fluid, a breaker bar or inertia bar could be dropped down the drill string to strike the diverter valve with sufficient force to shear the pin 22 and move the valve 20 axially sufficient to uncover ports 26, thereby providing an alternate flow path for draining the fluid from the drill string as it is tripped.

I claim:

1. An underreamer tool for enlarging an earth borehole, said tool comprising a tubular body having means for driving connection with a drill string and an axial bore extending therethrough; a plurality of cutter arms, including a cutter element, attached to said body by hinge means for movement between a retracted position wherein each arm and cutter element is disposed within an appropriately sized opening in said body and an outwardly extended position wherein said cutter element engages the borehole, said tool further including:

an axially moveable wash pipe disposed in the bore of said body including a piston member in sliding engagement with said bore and forming the upper end of said wash pipe and a depending pipe member in radially spaced relationship with the bore, said pipe and piston having an opening axially therethrough defining a primary drilling fluid flow path through said tool having an outlet below said hinge means and generally adjacent said cutter elements when in said extended position;

a secondary flow path through said body for delivering drilling fluid to said bore upstream of said hinge means to cause fluid flow from within said bore through said openings in said body when said arms are extended for flushing debris from between the extended arms and said tool body that would otherwise prevent said arms from retracting; and, valve means independent of said wash pipe for normally blocking said secondary flow path during normal drilling operation.

2. An underreamer tool according to claim 1 wherein:

said valve means is disposed in said bore upstream of said piston and is moveable from said blocking position to a position exposing inlet ports in said bore to said secondary flow path; and, means for normally maintaining said valve means in said blocking position, said means releasing said valve means for movement to a position exposing said inlet ports in response to an increased drilling fluid pressure thereon.

3. Structure according to claim 2 wherein said valve means includes an opening therethrough permitting fluid flow communication with said wash pipe and wherein said valve maintaining means includes a detent projecting from said bore into said valve means, such that when normal drilling flow through said valve means is blocked, the drilling fluid pressure on said valve means causes said detent to release said valve means.

4. Structure according to claim 3 wherein said detent is a shear pin.

5. An underreamer tool for enlarging an earth borehole, comprising a tubular body having means for driving connection with a drill string for delivering drilling fluid thereto, and an axial bore extending therethrough; a plurality of cutter arms, including a cutter element, hingedly attached to said body for movement between a retracted position wherein each arm and cutter element is disposed within an appropriately sized opening in said body and an outwardly extended position wherein said cutter element engages the borehole, said tool further including:

a wash pipe disposed in the axial bore of said body, including a piston member in sliding engagement with said bore and forming the upper end of said wash pipe and a depending pipe portion in radially spaced relationship with said bore said pipe and piston having an opening axially therethrough defining a primary drilling fluid flow path through said tool and having an outlet below said hinge means and generally adjacent said cutter elements when said arms are in said extended position;

a secondary flow path through said body having inlet ports in said bore upstream of said piston member for delivering drilling fluid to said space between said bore and the lower end of said wash pipe upstream of said hinge means to cause fluid flow from within said tool body through said openings in said body when said arms are extended for flushing debris otherwise preventing said arms from retracting; and, valve means independent of said wash pipe for normally blocking said inlet ports during normal underreaming operations.

6. An underreamer according to claim 5 wherein:

said valve means is disposed in said bore upstream of said piston and is moveable to a position exposing said inlet ports in said bore to said drilling fluid; and, detent means for normally maintaining said valve means in said blocking position, said detent means releasing said valve means for movement in response to an increased pressure on said valve means.

7. Structure according to claim 6 wherein said valve means includes an opening therethrough permitting fluid flow communication with said wash pipe.

8. Structure according to claim 7 wherein said detent means is a shear pin.

* * * * *